US005115525A

United States Patent [19]

Lovitt

[11] Patent Number: 5,115,525

[45] Date of Patent: May 26, 1992

[54] HAMMOCK MATTRESS

[76] Inventor: Harold B. Lovitt, 8427 Kirkwood Dr., Los Angeles, Calif. 90048

[21] Appl. No.: 683,805

[22] Filed: Apr. 11, 1991

[51] Int. Cl.[5] ..... A47C 27/08; A45F 3/22

[52] U.S. Cl. ..... 5/120; 5/448; 5/449

[58] Field of Search ..... 5/120-123, 5/448-450

[56] References Cited

U.S. PATENT DOCUMENTS

| | | | |
|---|---|---|---|
| 6,581 | 7/1849 | Seely | 5/120 X |
| 68,927 | 9/1867 | Woods | 5/122 X |
| 1,257,984 | 3/1918 | Drexler | 5/120 X |
| 1,401,846 | 12/1921 | Wiles | 5/121 |
| 2,284,900 | 6/1942 | Henderson et al. | 5/122 |
| 4,858,258 | 8/1989 | Mizelle | 5/448 X |

*Primary Examiner*—Michael F. Trettel

*Attorney, Agent, or Firm*—Blakely, Sokoloff, Taylor & Zafman

[57] ABSTRACT

A mattress for use on a suspended hammock. The mattress, which may be filled with a fluid or a resilient material, has a convex lower surface that compensates for the natural downward bowing or sagging that occurs in a hammock suspended by its ends. Since the cross-section of the mattress is curved, a convex lower surface fits into the downward bow of the cradle while an upper surface remains relatively flat. In a preferred embodiment, the mattress is oriented in the hammock longitudinally, parallel with the suspension wires supporting the hammock. In an alternative embodiment, the mattress is positioned transversely on the hammock, at right angles to the suspension wires. In yet another alternative embodiment, the suspension wires are attached directly to the mattress and the cradle is omitted.

16 Claims, 2 Drawing Sheets

HAMMOCK MATTRESS

BACKGROUND OF THE INVENTION

1. Field of the Invention

The present invention relates to a mattress adapted for use on a hammock. More precisely, the present invention relates to an inflatable mattress having an arcuate or convex lower surface that conforms to the curvature of the hammock, and a flat upper surface that provides a relatively level reclining surface for its occupant.

2. Description of the Prior Art and Related Information

A very popular way of lounging in the open outdoors is by reclining on a hammock. The conventional hammock is constructed from a sheet of fabric or woven material with suspension cables, ropes, or wires extending from opposite ends. The wires are tied to a rigid vertical post, one on each end, and in this manner suspend the hammock off the ground. Needless to say, any vertical fixture like a tree or wall, for example, can be used to support the hammock as long as there is something to tie the suspension wires to at each end.

There have been many variations upon the basic suspended hammock theme. For example, U.S. Pat. No. 2,284,900 to Henderson et al. discloses a basic hammock suspended on opposite ends by cables and features an enclosed sleeping area. An occupant can slip inside the enclosed area and be protected from outside elements and insects. Another variation, U.S. Pat. No. 6,581 to Seely, discloses a conventional hammock particularly for use on ships. The hammock is modified by inflatable tubes incorporated into the sleeping surface. The purpose of incorporating the airbags is so that in case of a shipwreck, the hammock may be used as a life preserver or a life raft. Yet another variation upon the basic hammock theme is disclosed in U.S. Pat. No. 1,329,687 to Underwood. This patent teaches a hammock designed to float on water. In particular, the hammock features a cradle or stretcher portion that is held taut between two buoyant supports fastened to opposite extremities of the cradle portion. While an occupant lies supine on the cradle portion, his body is kept afloat on the surface of the water by the buoyant supports. The buoyant support may be made from a pneumatic bag, for example.

Although the foregoing explore the variations on a hammock, none specifically address the comfort in lying on a suspended hammock. To be sure, the goal of improving comfort has mainly centered around household furniture such as a mattress for a bed, a cushion for a sofa or a chair, etc. For instance, U.S. Pat. No. 4,428,087 to Horn, discloses a therapeutic air mattress having strategically located air chambers. Each chamber, once pressurized, supports predetermined parts of a person's body when he or she lies prone thereon. U.S. Pat. No. 529,852 to Brupbacher, discloses an air or water filled mattress. U.S. Pat. No. 4,914,762 to Perali et al. discloses an inflatable cushion particularly suited for use on seats or couches to support and keep a user's trunk erect and in a vertical position with respect to his thighs, thereby making his prolonged sitting or prone posture less stressful. Thus, nothing in the prior art contemplates improving the comfort of lying on a hammock.

A major obstacle in the way of improving comfort is the downward bowing that naturally occurs in the middle of a hammock. Obviously, when something is held up by its ends, the center sags downward due to the pull of gravity. Once a person climbs into the hammock, the sagging or downward bowing is even more pronounced because of the added weight. The bowing forces the occupant's spine to bend downward accordingly when he is in a supine position. Even worse, if the occupant is lying on his stomach, the bowing in the hammock causes him to uncomfortably arch his back. Such unavoidable contortions prevent many people from using and enjoying the benefits of a hammock. There are also possible adverse effects on the spine from such unnatural bending. Accordingly, a need presently exists for improving the comfort of a hammock.

SUMMARY OF THE INVENTION

The present invention provides an inflatable mattress featuring a convex bottom that conforms with the common downward bowing in a suspended hammock. The upper surface of the mattress, on the other hand, is relatively flat, allowing an occupant resting prone thereon to assume a comfortable posture without having to arch his spine unnaturally.

Therefore, it is an object of the present invention to provide a mattress that is to be used in conjunction with a suspended hammock. It is another object of the present invention to provide a mattress having a bottom that is convex to conform with the downward sag in the hammock, while the mattress's upper surface provides a relatively flat reclining area. It is yet another object of the present invention to provide a mattress that is inflatable. It is still another object of the present invention to provide a mattress with a convex bottom that may be arranged either substantially parallel or substantially perpendicular to the suspension wires.

DETAILED DESCRIPTION OF THE INVENTION

The following description is of the best presently contemplated mode of carrying out the invention. This description is made for the purpose of the illustrating the general principles of the invention, and is not to be taken in a limiting sense. Therefore, the scope of the invention is best determined by reference to the appended claims.

Figure 1:
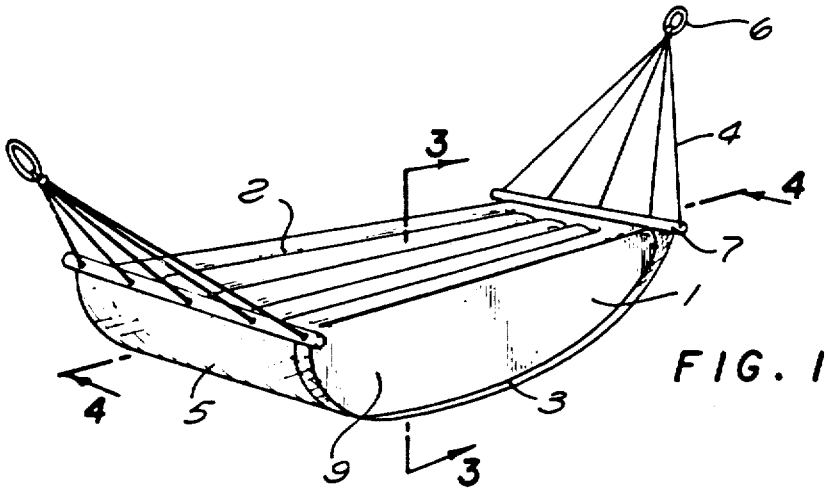
FIG. 1 is a perspective view of a preferred embodiment of the present invention, illustrating a mattress adapted to a suspended hammock.

FIG. 1 illustrates a preferred embodiment of the present invention. The drawing depicts a hammock having a sling or cradle 5 that is supported on opposite ends by suspension means such as cords or wires 4. The suspension wires 4 are attached to a frame 7. The frame 7 helps give the cradle 5 its shape; without the frame 7 the cradle 5 tends to collapse into itself. Nevertheless, the frame 7 is not critical to the practice of the present invention. Connecting the suspension wires 4 to a vertical post (not shown) is a ring 6. Of course, the ring 6 and vertical post are provided merely for illustration. A person skilled in the art would be able to find numerous ways to suspend the hammock. FIG. 1 also shows a mattress 1 positioned on the cradle 5. The mattress 1 is arranged lengthwise on the cradle 5 so that the lower surface 3 of the mattress 1 conforms with the curvature of the cradle 5.

Figure 5:
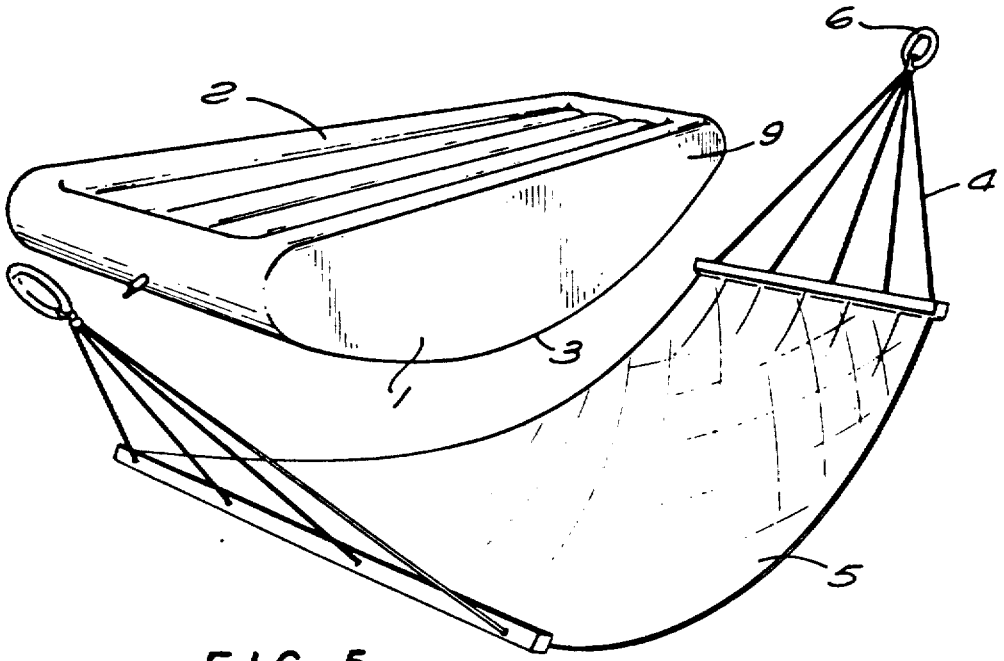
FIG. 5 is an exploded perspective view of the present invention.

FIG. 5 is an exploded, perspective view of a preferred embodiment of the present invention. Shown here is the downward sagging that occurs in the cradle 5 when the hammock is suspended by the suspension wires 4 on each end. Once a person climbs into the hammock, the sagging is even more pronounced due to the pull of gravity on the person's body weight. An occupant lying prone on the cradle 5 must either strenuously fight gravity or relax his muscles and allow his body to sag along with the cradle 5. Since the cradle 5 does not give much upward support, the sagging or bowing is severe. Contorting one's body to follow the sag in the cradle 5 is undoubtedly painful and perhaps even injurious to the spine.

Fortunately, the present invention provides a mattress 1 that when positioned properly on the cradle 5, compensates for the sag. As shown in FIG. 5, the convex curvature in the lower surface 3 of the mattress 1 duplicates the downward bowing of the cradle 5.

Figure 4:
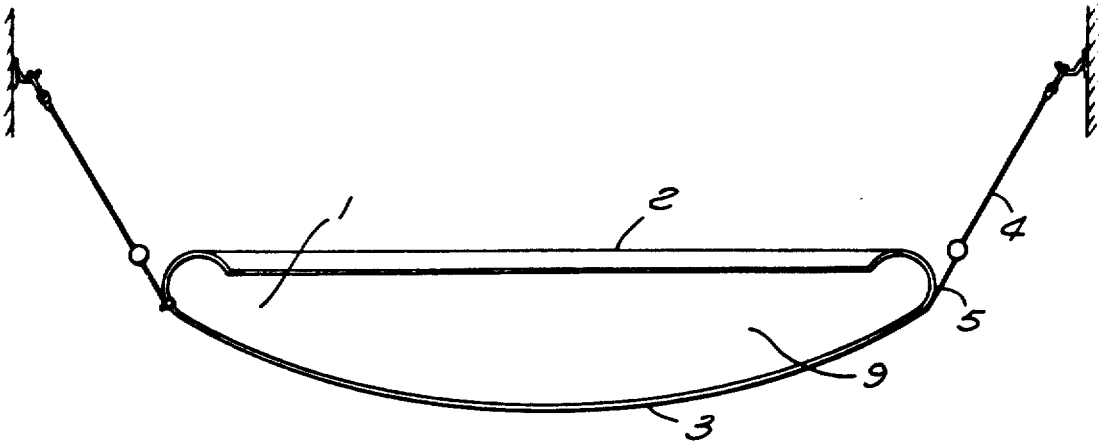
FIG. 4 is a cross-sectional view of a preferred embodiment mattress taken along line 4—4 of FIG. 1.

Supplying a better view of the fitment between the mattress 1 and the cradle 5 is FIG. 4, which is a sectional view of the invention taken along line 4—4 of FIG. 1. From this cross-sectional view, one can see that the cradle 5 follows the convex lower surface 3 of the mattress 1. Indeed, each side panel 9 of the mattress 1 has as a shape generally defined by a curved edge subtended by a straight edge. This nearly semicircular shape allows the upper surface 2 of the mattress 1 to become horizontal, thus providing a flat reclining area. A person lying prone on the mattress 1 would therefore have support for his back from the relatively level upper surface 2. In this manner, the mattress 1 compensates for the downward bowing in the cradle 5. Also with a flat upper surface 2, a hammock with the mattress 1 more closely resembles a traditional bed, which is much better suited as a place for rest. In an alternative embodiment (not shown), crescent-shaped side panels 9 are possible, thereby producing a slight concave in the upper surface 2. The slight concave might be desirable for orthopedic or therapeutic purposes. Likewise, gibbous-shaped side panels 9 produce a convex upper surface 2, which again might be useful for certain purposes.

Figure 3:
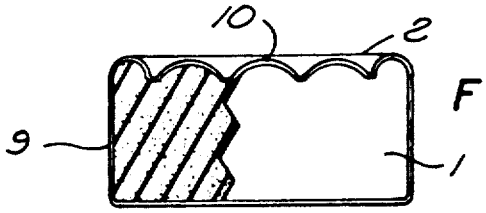
FIG. 3 is a cross-sectional view of a preferred embodiment mattress taken along line 3—3 of FIG. 1.

FIG. 3 is a cross-sectional view of the mattress 1 taken along line 3—3 of FIG. 1. Apparent in this illustration are the ripples 10 covering the entire upper surface 2. The ripples 10 act as miniature cushions that improve the texture and feel of the mattress 1. Of course, other features and structures known in the art may be formed into the upper surface 2. For example, a pillow may be formed at one end of the mattress 1 as well as a foot rest at the opposite end. Indeed, many mattress designs are possible without departing from the breadth and spirit of the present invention. Lastly, the side panels 9 need not be at right angles to the upper surface 3 as shown; the panels 9 could be configured in many different ways to obtain a specific design objective.

Figure 2:
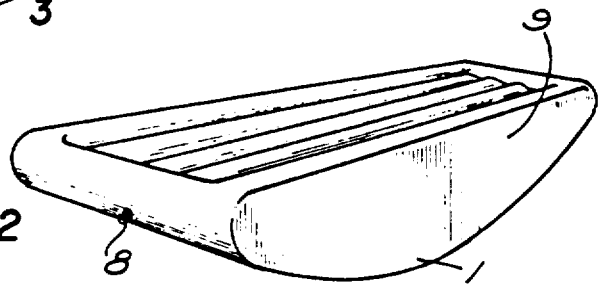
FIG. 2 is a perspective view of a preferred embodiment of the present invention.

FIG. 2 is a perspective view of the mattress 1. The mattress 1 shown in this preferred embodiment happens to be pneumatic. Thus, a valve 8 protrudes from one end of the mattress 1. Any fluid such as air, carbon dioxide, water, etc., may be used to fill the void inside the mattress 1. Many other fluids known in the art but not mentioned here may be used, too. In an alternative embodiment, the mattress 1 may be filled with foam, springs, rubber, sponge, or any resilient material as illustrated in the left portion of FIG. 3. Furthermore, the mattress 1 itself may be fabricated from plastic, cloth, rubber, or any variety of materials suitable for use as a mattress. In short, regardless of mattress design, the salient features provided by the present invention include a convex lower surface 3 that compensates for the bowling in the cradle 5, thereby providing a relatively flat upper surface 2 on which an occupant may lie prone.

Figure 6:
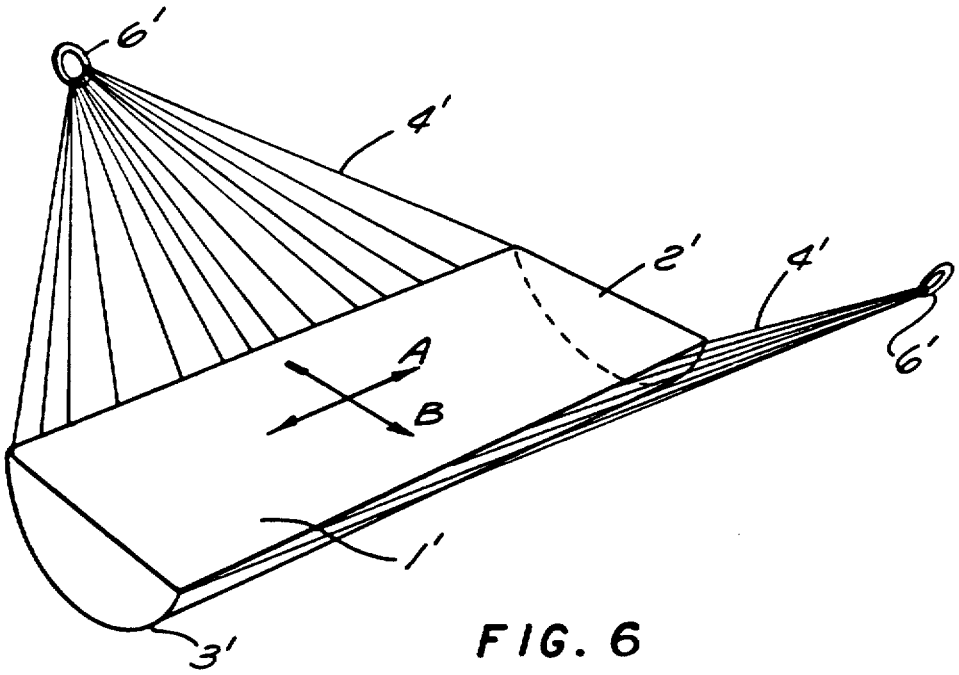
FIG. 6 is a perspective view of an alternative embodiment of the present invention.

FIG. 6 is a perspective view of an alternative embodiment of the present invention. One way to look at this embodiment is to see that it is essentially similar to the mattress 1 from the earlier embodiments, but rotated 90 degrees relative to the suspension wires 4. Now the mattress 1' is supported transversely on either side by suspension wires 4', which terminate at rings 6'. The rings 6' are mounted to a fixture strong enough to hold the hammock off the ground.

In this orientation, the convex lower surface 3' arches transversely (i.e., bending around axis A) instead of the longitudinally (i.e., bending around axis B). Nonetheless, similar principles are in effect here as in the earlier embodiments. Even though the convex lower surface 3' is curved transversely, there is stiffness along the A direction, which extends the length of the mattress 1'. That rigidity in the mattress 1' resists bending along the A direction. Along the B direction, the arcuate shape of the mattress 1' with its convex lower surface 3' compensates for the downward bowing in the cradle, as before. Thus configured, the sleeping area on the upper surface 2' stays relatively flat.

In still another alternative embodiment (not shown), the mattress is suspended by the wires at opposite ends similar to what is diagrammed in FIG. 1. Except in this alternative embodiment, the cradle is omitted leaving just the mattress to which the suspension wires are directly connected.

In summary, the present invention provides a mattress adapted to a cradle of a suspended hammock. A convex-shaped lower surface of the mattress compensates for the natural downward sagging or bowing that occurs in a hammock suspended by its ends. Since the mattress has an arcuate cross-section, the upper surface is relatively flat, thus providing a level sleeping or resting area.

What is claimed is:

1. A mattress adapted for use on a suspended hammock of the type that is suspended from two points which define a longitudinal axis comprising:

a substantially flat upper surface having four edges;

two longitudinally extending side panels, wherein each side panel has a substantially straight edge that is subtended by a longitudinally curved edge, and the straight edge abuts the upper surface on opposite edges; and a convex lower surface having two longitudinally arcuate edges and two straight edges, wherein the arcuate edges engage the curved edge of each side panel and the straight edges engage two edges of the flat upper surface.

2. A mattress according to claim 1, wherein the mattress is filled with a fluid.

3. A mattress according to claim 2, wherein the fluid is air.

4. A mattress according to claim 3, wherein a fluid admitting valve is disposed on the convex lower surface.

5. A mattress according to claim 2, wherein the fluid is a liquid.

6. A mattress according to claim 1, wherein the mattress is filled with a resilient material.

7. A mattress according to claim 6, wherein the resilient material is foam.

8. A mattress according to claim 1, wherein the mattress is made from a polymer material.

9. A mattress adapted for use on a hammock of the type that is suspended from two points which define a longitudinal axis comprising:

a mattress including a substantially flat upper surface, a convex lower surface engaging the upper surface, and longitudinally extending side panels each defined by a longitudinally curved edge subtended by a substantially straight edge, attached to the upper surface and lower surface on opposite sides.

10. A mattress according to claim 9, wherein the mattress is filled with a fluid.

11. A mattress according to claim 9, wherein the mattress is filled with a resilient material.

12. A mattress adapted for use on a suspended hammock of the type that is suspended from two points which define a longitudinal axis comprising:

a substantially flat upper surface with a shape defining a polygon having a first, a second, a third, and a fourth edge, wherein the first edge is opposite the third edge and the second edge is opposite the fourth edge, and the first and third edges extend generally parallel to the longitudinal axis;

a first side panel having a longitudinally curved edge subtended by a substantially straight edge, wherein the straight edge engages the first edge of the upper surface;

a second side panel having a longitudinally curved edge subtended by a substantially straight edge, wherein the straight edge engages the third edge of the upper surface; and a substantially convex lower surface with a shape defining a four-edge polygon having two longitudinally arcuate edges oppositely disposed from each other and two straight edges, wherein the two arcuate edges respectively engage the curved edge of the first side panel and the curved edge of the second side panel, and the straight edges respectively engage the second edge and the fourth edge of the upper surface.

13. A mattress according to claim 12, wherein the mattress is filled with a fluid.

14. A mattress according to claim 12, wherein the mattress is filled with a resilient material.

15. A device for lounging comprising:

a hammock having a cradle suspended at longitudinally opposite ends; and a mattress positioned on the cradle, wherein the mattress includes a substantially flat upper surface, a convex lower surface engaging the flat upper surface, two side panels each having a longitudinally arcuate edge subtended by a substantially straight edge in which the straight edge engages the flat upper surface and the arcuate edge engages the convex lower surface.

16. A mattress for use in connection with a hammock suspended at longitudinally opposite ends and bowing downwardly therefrom, wherein the mattress is elongated in a longitudinal direction and shaped with a substantially flat upper surface and a convex lower surface that is curved, in elevation in the longitudinal direction so as to conform to the downward bowing of the hammock.

* * * * *

UNITED STATES PATENT AND TRADEMARK OFFICE

CERTIFICATE OF CORRECTION

PATENT NO. : 5,115,525
DATED : May 26, 1992
INVENTOR(S) : Lovitt

It is certified that error appears in the above-indentified patent and that said Letters Patent is hereby corrected as shown below:

column 4, line 14, change:

"bowling" to -- bowing -- column 5, line 21, change:

"panels" to -- panels, --

Signed and Sealed this

Fourteenth Day of March, 1995

*Attest:*

BRUCE LEHMAN

*Attesting Officer*

*Commissioner of Patents and Trademarks*